US012127717B2

(12) United States Patent
Lewis et al.

(10) Patent No.: US 12,127,717 B2
(45) Date of Patent: Oct. 29, 2024

(54) PAPER PRODUCT DISPENSER CUTTING SYSTEM

(71) Applicant: Kimberly-Clark Worldwide, Inc., Neenah, WI (US)

(72) Inventors: Richard P. Lewis, Marietta, GA (US); Matthew T. Woerpel, Lodi, WI (US); Jeffrey J. Brickl, Prairie du Sac, WI (US); Edward A. Raleigh, Lodi, WI (US); Robert J. Godfrey, Monona, WI (US); Blake Wagner, Poynette, WI (US); Morgan Lowery, DeForest, WI (US); Gregory J. Hallingstad, DeForest, WI (US); Chad N. Klink, Beaver Dam, WI (US); Luke J. Sackash, Madison, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 335 days.

(21) Appl. No.: 17/607,477

(22) PCT Filed: Apr. 23, 2020

(86) PCT No.: PCT/US2020/029581
§ 371 (c)(1),
(2) Date: Oct. 29, 2021

(87) PCT Pub. No.: WO2020/223110
PCT Pub. Date: Nov. 5, 2020

(65) Prior Publication Data

US 2022/0192440 A1 Jun. 23, 2022

Related U.S. Application Data

(60) Provisional application No. 62/841,120, filed on Apr. 30, 2019.

(51) Int. Cl.
*A47K 10/36* (2006.01)

(52) U.S. Cl.
CPC ..... *A47K 10/3643* (2013.01); *A47K 10/3606* (2013.01); *A47K 2010/3668* (2013.01); *Y10T 83/4766* (2015.04)

(58) Field of Classification Search
CPC .... A47K 10/3606; A47K 10/32; A47K 10/34; A47K 10/3631; A47K 10/3643;
(Continued)

(56) References Cited

U.S. PATENT DOCUMENTS 5,078,033 A 1/1992 Formon
5,257,711 A 11/1993 Wirtz-Odenthal
(Continued)

FOREIGN PATENT DOCUMENTS

CN 1655710 A 8/2005
CN 201044730 4/2008
(Continued)

OTHER PUBLICATIONS

Chuangdian, "Bathroom Roll Paper Towel Dispenser Auto Cut Jumbo Roll Tissue Dispenser Q0P4", ebay.com, https://www.ebay.com/itm/162433889172?rmvSB=true.
(Continued)

*Primary Examiner* — Phong H Nguyen

(57) ABSTRACT

Systems, methods and apparatus for dispensing of paper products. A paper product dispenser comprising a housing comprising a product holding area configured to hold a roll; a rotating member configured to rotate, in a first direction, in response to rotation of the roll; a cutting surface in the housing; a cutting blade coupled to the rotating member and having a first position, and a second position in which the cutting blade is in contact with the cutting surface, wherein the rotating member is configured to (i) move the cutting
(Continued)

blade from the first position to the second position during a first portion of a rotation cycle of the roll in the first direction and (ii) move the cutting blade from the second position to the first position during a second portion of the rotation cycle of the roll in the first direction.

17 Claims, 5 Drawing Sheets

(58) Field of Classification Search
CPC ..... A47K 2010/3668; Y10T 83/4766; Y10T 83/896; Y10T 225/20; Y10T 225/216; Y10T 225/218; Y10T 225/276; Y10T 225/295; Y10T 225/298; Y10T 225/16; Y10T 225/30; B65H 16/00; B65H 16/005
USPC ..... 242/550, 553, 554.2, 564
See application file for complete search history.

(56) References Cited

U.S. PATENT DOCUMENTS

| | | | | |
|---|---|---|---|---|
| 6,079,305 | A | 6/2000 | Bloch et al. | |
| 6,553,879 | B2 | 4/2003 | Morand | |
| 6,581,500 | B1 | 6/2003 | Kietaibl | |
| 6,591,727 | B1 | 7/2003 | Purcell et al. | |
| 6,684,751 | B2 | 2/2004 | Kapiloff et al. | |
| 7,347,134 | B2 * | 3/2008 | Lewis | A47K 10/36 225/10 |
| 7,398,944 | B2 | 7/2008 | Lewis et al. | |
| 7,987,756 | B2 | 8/2011 | Lewis et al. | |
| 8,943,938 | B2 | 2/2015 | Sahlberg | |
| 9,144,352 | B2 | 9/2015 | Cittadino et al. | |
| 2002/0073819 | A1 | 6/2002 | Phelps et al. | |
| 2003/0110915 | A1 | 6/2003 | Kapiloff et al. | |
| 2003/0116003 | A1 * | 6/2003 | Kapiloff | A47K 10/36 83/649 |
| 2012/0312853 | A1 | 12/2012 | Osborne et al. | |
| 2013/0334357 | A1 | 12/2013 | Huruse | |
| 2015/0082960 | A1 | 3/2015 | Niada | |

FOREIGN PATENT DOCUMENTS

| | | | |
|---|---|---|---|
| EP | 2410897 | B1 | 4/2017 |
| JP | 2004024378 | A | 1/2004 |
| JP | 2012131567 | | 7/2012 |
| KR | 19980074446 | A | 11/1998 |
| WO | 2006041519 | | 4/2006 |
| WO | 2018126236 | | 7/2018 |

OTHER PUBLICATIONS

Palmer, "Mechanical Auto-Cut Roll Towel Dispenser", wayfair.com, https://www.wayfair.com/commercial/pdp/palmer-fixture-mechanical-auto-cut-roll-towel-dispenser-plmr1012.html.

* cited by examiner

PAPER PRODUCT DISPENSER CUTTING SYSTEM

This application claims priority from U.S. provisional Patent Application Ser. No. 62/841120 filed on 30 Apr. 2019, the entire contents of which are incorporated herein by reference.

This disclosure generally relates to a consumable product dispensing system.

BACKGROUND

Systems dispensing consumable products are common in many environments today. For example, consumable product dispensers, e.g., bath tissue dispensers, are used in many private, semi-private and public washrooms. Some washroom occupants tend to take excessive amounts of, for example, bath tissue while others have difficulty tearing bath tissue from the roll. Thus it is desirable to have a washroom dispenser that provides an automatic cutting system to both control the amount of product used and assist occupants tearing tissue from the roll.

SUMMARY

In general, the subject matter of this specification relates to a paper product dispenser (e.g., hygienic dispensers) for rolled products such as bath tissue rolls. One aspect of the subject matter described in this specification can be implemented in systems that include a paper product dispenser comprising a housing comprising a product holding area configured to hold a roll; a rotating member configured to rotate, in a first direction, in response to rotation of the roll; a cutting surface in the housing; a cutting blade coupled to the rotating member and having a first position, and a second position in which the cutting blade is in contact with the cutting surface, wherein the rotating member is configured to (i) move the cutting blade from the first position to the second position during a first portion of a rotation cycle of the roll in the first direction and (ii) move the cutting blade from the second position to the first position during a second portion of the rotation cycle of the roll in the first direction. Other embodiments of this aspect include corresponding apparatus and methods.

Yet another aspect of the subject matter described in this specification can be implemented in systems that include a paper product dispenser comprising a housing comprising a product holding area configured to hold a roll; a rotating member configured to rotate, in a first direction, in response to rotation of the roll; a cutting surface in the housing; a cutting blade coupled to the rotating member and having a first position distal from the cutting blade and a second position in which the cutting blade is in contact with the cutting surface, wherein the rotating member is configured to (i) move the cutting blade from the first position to the second position during a first portion of a rotation cycle of the roll in the first direction and (ii) disengage the cutting blade during a second portion of the rotation cycle of the roll in the first direction. Other embodiments of this aspect include corresponding apparatus and methods.

Particular embodiments of the subject matter described in this specification can be implemented so as to realize one or more of the following advantages. For example, some users withdraw an excessive amount of paper product from the dispenser, which can lead to elevated costs for the dispenser owner and deplete the dispenser so that not enough product is available for the next user. To combat this the dispenser includes an automatic cutoff feature that severs (cuts) a specified length of product from the roll for each use to ensure the user is not excessively using product, which can be very wasteful. Further, the cutoff system severs the product from the roll such that enough of the unrolled product remains to present a tail of this unrolled portion at the dispensing port of the dispenser. Otherwise, the tail might not be long enough to present at the dispensing port for access by a user, and the user might think the dispenser is out of product or is malfunctioning.

The details of one or more implementations of the subject matter described in this specification are set forth in the accompanying drawings and the description below. Other features, aspects, and advantages of the subject matter will become apparent from the description, the drawings, and the claims.

DESCRIPTION OF DRAWINGS

Like reference symbols in the various drawings indicate like elements.

DETAILED DESCRIPTION

The present disclosure generally relates to a rolled paper product dispenser.

Figure 1A:
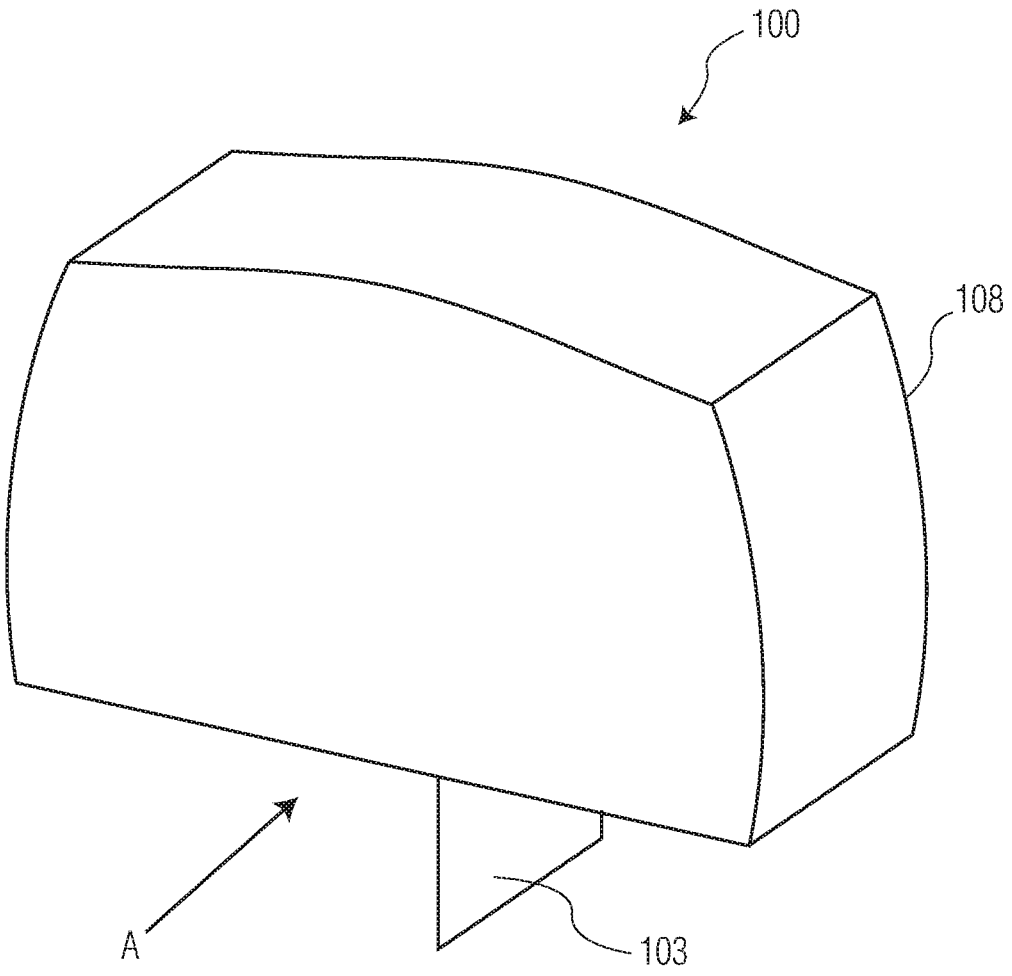
FIG. 1A is a representation of an example paper product dispenser.

In some implementations, the dispenser includes a cutting blade that is driven by the rotation of the product roll (e.g., bath tissue roll) during a dispensing process. As the roll rotates the cutting blade is driven from its initial position to towards and eventually into contact with a cutting surface to pinch and sever/cut an unwound portion of the roll located between the cutting blade and the cutting surface. The cut, unwound portion of the roll is then available to a user. As the roll is further rotated, e.g., during the end of the current dispensing cycle or during a next dispensing cycle, the cutting blade returns to its initial position and is once again ready to drive towards the cutting surface to dispense another portion of the unwound roll. The dispenser is described in more detail below with reference to FIG. 1A, which is a representation of an example paper product dispenser 100, and FIG. 1B, which is a side cutaway representation of an example paper product dispenser 100 (looking into the side of the dispenser 100 with reference to direction A in FIG. 1A).

The dispenser 100 can be, for example, a bath tissue dispenser 100, hand towel dispenser, wipe/wiper dispenser or the like for rolled paper products 102. A paper product describes sheet materials made from cellulose fibers (e.g., wood pulp), synthetic fibers (e.g., polypropylene) or some combination thereof, and include, for example, bath tissue, paper towels and wipes/wipers including made from woven and nowoven technologies. A rolled product (or roll) 102 is a product that is wound around a core or center axis.

The dispenser 100 includes a body or housing 108, e.g., a composite or metal housing. The dispenser 100 also includes a product holding area 110 to hold the rolled product 102 (roll 102). Generally, the product holding area 110 is a space or cavity within the body 108 in which the roll(s) 102 can be positioned for dispensing. In some implementations, a tail 103 of the roll 102 is presented for the user to grab to, for example, initiate a dispenser cycle.

Figure 1B:
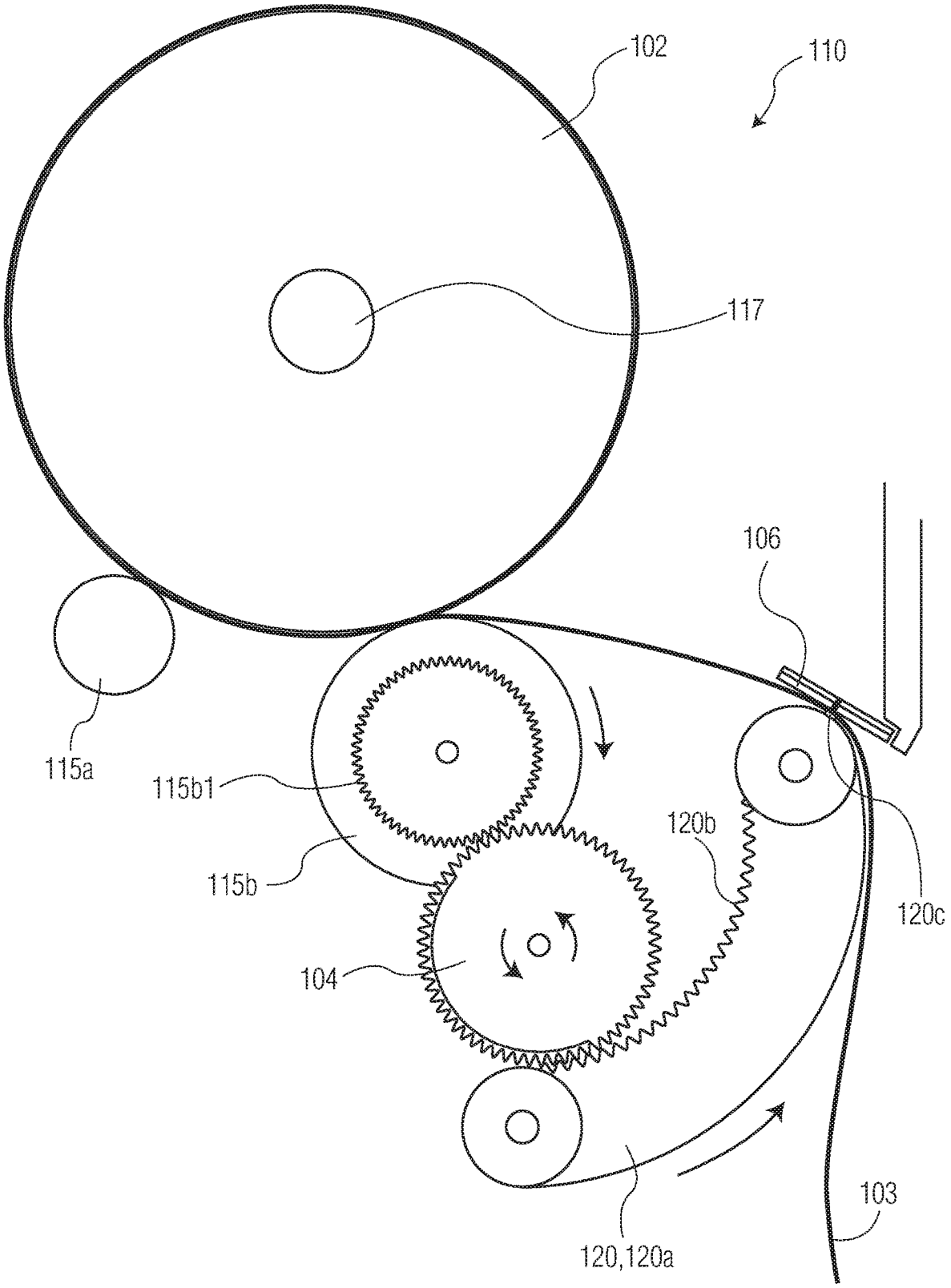
FIG. 1B is a side cutaway representation of an example paper product dispenser

In some implementations, the dispenser 100 includes a first spindle arm 115*a* and a second spindle arm 115*b* (or support roller 115*b*) in the product holding area 110. In combination, the first and second spindles 115*a, b* are used to hold the roll 102 along its periphery, as shown in FIG. 1B, and rotate to facilitate unwinding the roll 102 for dispensing to a user. The spindle arms 115*a, b* are positioned, for example, between the sides of the dispenser 100. Each spindle arm 115*a, b,* in some implementations, includes a roller or other rotation device that rotates along with (or drives) the unwinding of the roll 102. In some implementations, the spindle arms 115*a, b* do not rotate. In this case, for example, the rolled product 102 can rotate in place (held and supported by the spindle arms 115*a, b*) in response to a user pull on an exposed portion (e.g., tail 103) of the roll 102.

One of both spindle arms 115*a, b,* in some implementations, are positioned to be below the core 117 of the roll 102 they are supporting. More generally, the two spindle arms 115*a, b* are positioned relative to each other to allow a roll 102 to rest on them and not fall off from gravity, and, to this end, are placed no further apart than the diameter of the roll 102. In some implementations, other support devices can additionally or alternatively be used to support and/or hold the roll 102, as described below.

In some implementations, instead of the spindle arms 115*a, b,* the dispenser 100 includes a core support mechanism (not pictured). The core support mechanism can be a core spindle (or rod) that extends through the core 117 and is supported on one or both of the left and right side of the dispenser 100 (e.g., on cradles affixed to the sides of the dispenser 100). In these implementations, the core support mechanism is removable to allow it to be inserted into the core 117 of the roll 102 and then placed, for example, in the cradles.

In some implementations, the dispenser 100 includes support arms that extend from either side of the dispenser 100 and engage the core 117 of the roll 102 on each respective side to hold the roll 102 in the product holding area 110. For example, the arms include nubs or other extensions that at least partially insert (e.g., project) into the core 117 on either side of the roll 102 to hold it. The arms are, for example, semi-rigid such that they can be flexed apart to allow the roll 102 to be placed in between and then released to "pinch" the roll and rotatably hold the roll 102.

The dispenser 100 includes a rotating member 104 to rotate, in a first direction, in response to rotation of the roll 102. For example, in response to the roll 102 rotating during a dispense cycle the rotating member 104 rotates in a counterclockwise direction (e.g., the first direction).

Figure 1C:
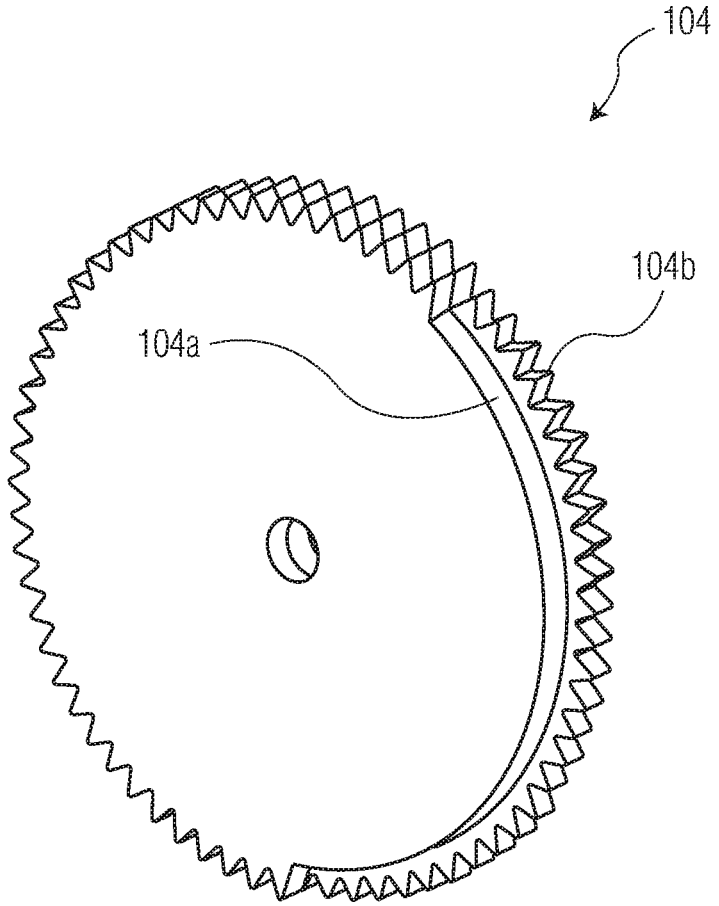
FIG. 1C is a representation of an example rotating member.

The rotating member 104, in some implementations, includes two circular gears, as shown in FIG. 1C, which is a representation of an example rotating member 104. For example, the rotating member 104 includes a first circular gear 104*a* with gear teeth along less than all of its circumference and a second circular gear 104*b* with gear teeth along its entire circumference. In some implementations, the first circular gear 104*a* and the second circular gear 104*b* are coupled together in a side-by-side arrangement as shown in FIG. 1C. As described below, for some implementations, these gears 104 can respectively engage one of the spindles 115 and the cutting blade 120 to drive the cutting blade 120, during a dispense cycle, to cut an unwound portion of the roll 102.

As described above, in some implementations, the rotating member 104 is coupled to one of the spindles 115. For example, spindle arm 115*b* can be a drive roller 115*b* that (through mechanical or electromechanical actuation) rotates the roll 102 during a dispense cycle. As such, the drive roller 115*b* can include an engagement device to couple to the rotating member 104, for example, a drive roller gear 115*b*1 that rotates in concert with the drive roller 115*b*. In turn, the drive roller gear 115*b*1 can engage the second circular gear 104*b* of the rotating member 104 to rotate the rotating member 104 in response to rotation of the roll 102. For example, as the roll 102 rotates in a counterclockwise direction (e.g., during a dispense cycle) the drive roller 115*b* rotates in a clockwise direction, which then causes (e.g., through drive roller gear 115*b*1 engaging the second circular gear 104*b*) the rotating member 104 to rotate in a counterclockwise direction.

Figure 2A:
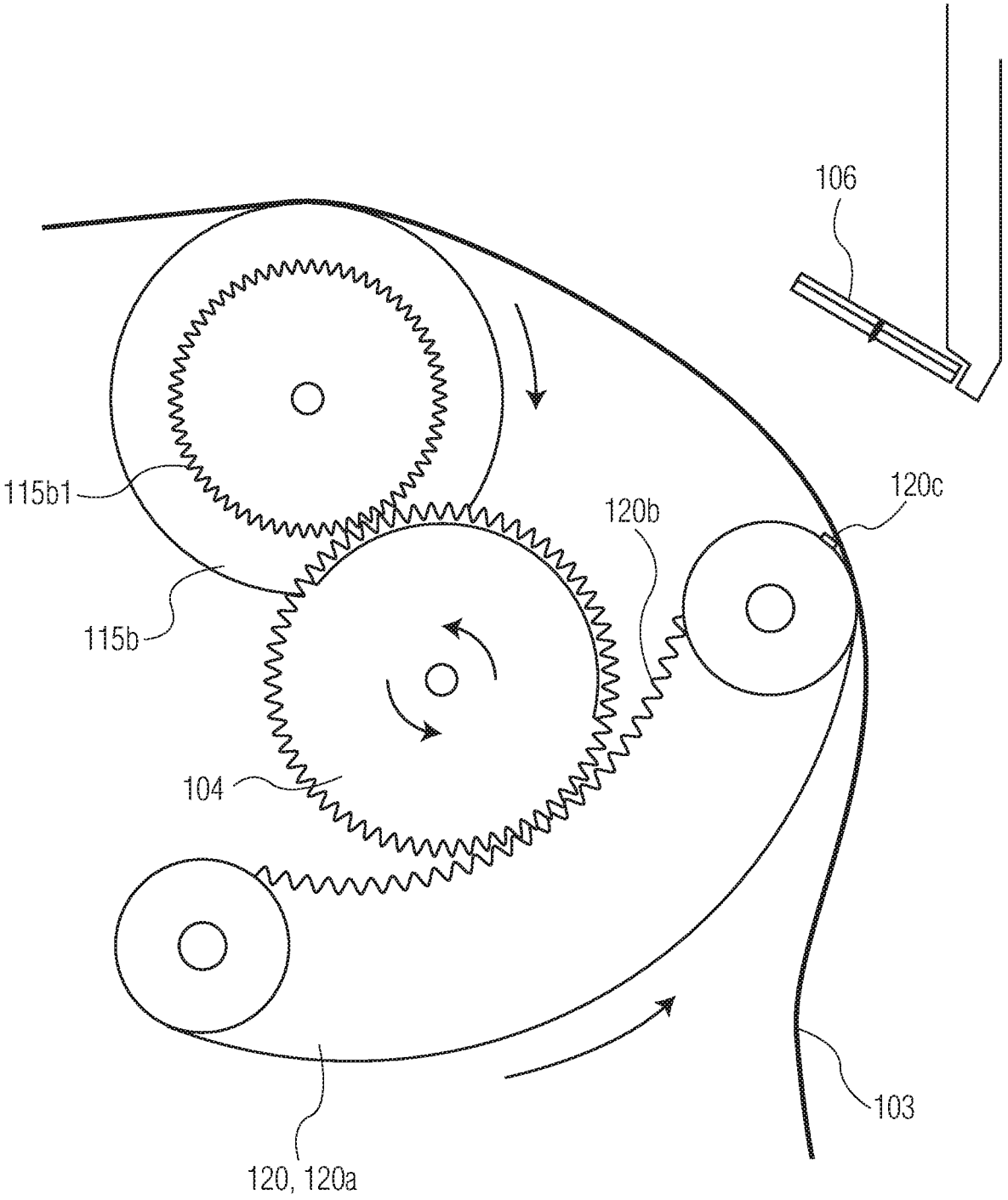
FIG. 2A is a detailed representation of an example cutting blade and rotating member.

The dispenser 100 includes a cutting blade 120. The cutting blade 120 functions to cut an unwound portion of the roll 102 from the remainder of the roll 102 for access and use by a user. In some implementations, the cutting blade 120 includes elongated track 120*a* with teeth 120*b* and a knife 120*c* at an end of the track 120*a*. For example, during the dispense cycle the first circular gear 104*a* of the rotating member 104 engages the teeth 102*b* of the cutting blade 120 to drive the knife 120*c* towards and into contact with the cutting surface 106 (e.g., a hard surface against which the knife 120*c* can press the unwound portion of the roll 102 to sever or cut it from the rest of the roll 102). This process is described in more detail below with reference to FIG. 1B, FIG. 2A, which is a detailed representation of an example cutting blade and rotating member, and 2B, which is s another detailed representation of an example cutting blade and rotating member.

Figure 2B:
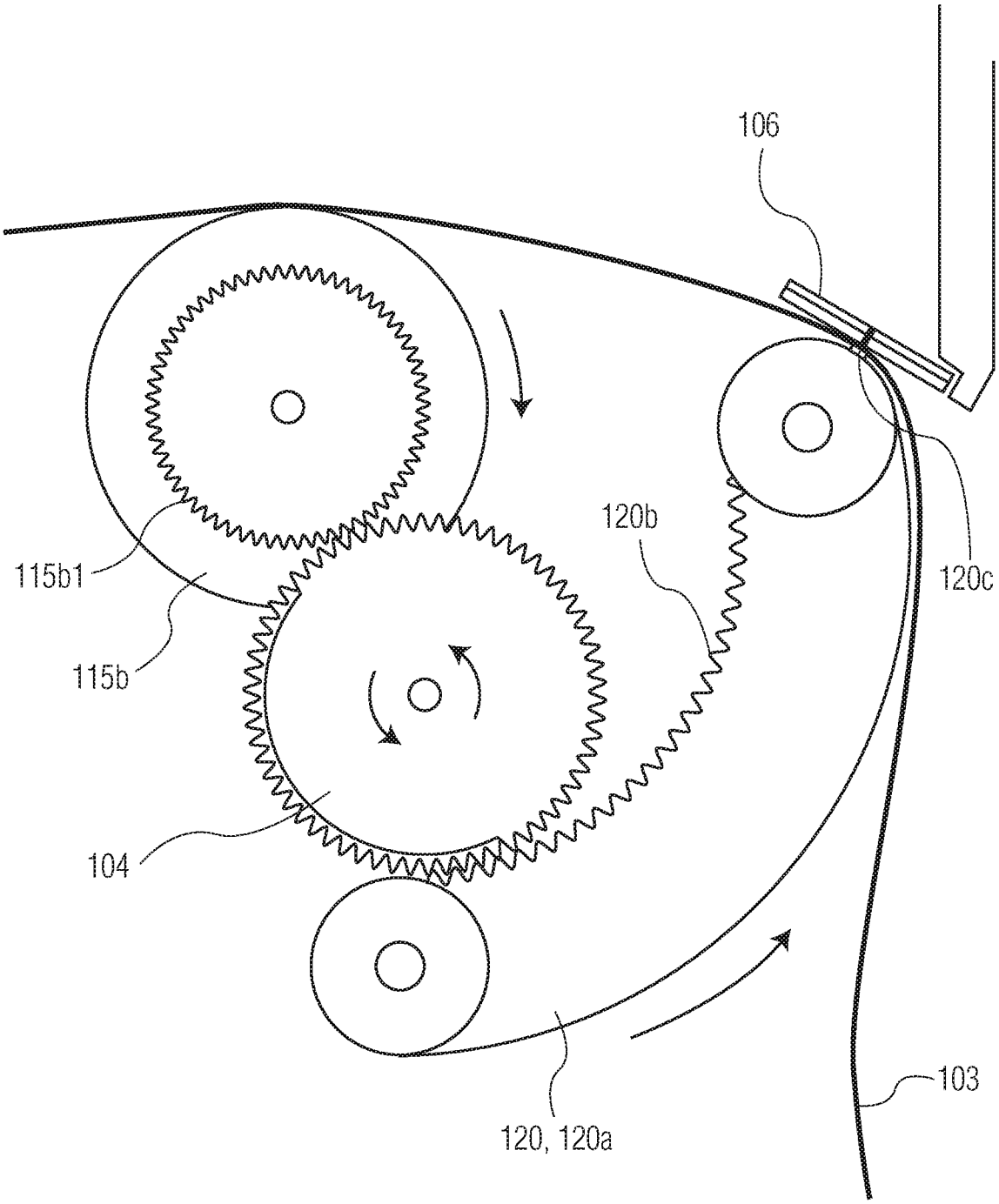
FIG. 2B is another detailed representation of an example cutting blade and rotating member.

In some implementations, the rotating member 104 moves the cutting blade 120 between a first position (e.g., distal the cutting surface 106) and a second position in which the cutting blade 120 (e.g., the knife 120*c*) is in contact with the cutting surface 106. The cutting blade 120 is in the first position as shown in FIG. 2B. The cutting blade 120 is in the second position as shown in FIG. 1B.

In operation, the cutting blade 120 starts from the first position (e.g., prior to a dispense cycle). As the dispense cycle progresses the cutting blade 120 moves from the first position toward the second position (e.g., through a linear or arcuate path as shown, for example, in FIG. 2A). Thus, in some implementations, the cutting blade 120 does not complete a full rotation but rather moves back and forth along a linear or arcuate path, but not along a full circular path. The dispense cycle can be initiated, for example, by a user pulling on the tail 103 of the roll 102 and manually unwinding the roll 102 or through a trigger (proximity sensor or button) that actuates a motor (e.g., coupled to the drive roller 115*b* that rotates the drive roller 115*b*) and unwinds the roll 102.

In some implementations, for a full dispensing cycle, the drive roller 115*b* engages the rotating member 104 through the second circular gear 104*b* to cause the rotating member 104 to rotate. In turn, the first circular gear 104*a* of the rotating member 104 engages the cutting blade 120 (e.g., at the first position) through the teeth of the track 120*b* to move the cutting blade 120 towards and into the cutting surface 106. This is referred to as the first portion of a rotation cycle. As described above, the first circular gear 120*a* does not have teeth along a portion of its circumference. As such, this bare section (toothless section) of the first gear 104*a* is sized such that the bare section starts when the cutting blade 120 contacts (e.g., sufficiently to cut the roll 102) the cutting surface 106 at the second position. Thus, at the point when the unwound portion of the roll 102 is cut, there is no longer an engagement between the rotating member 104 and the cutting blade 120 so the cutting blade 120 moves back to the first position, e.g., through gravity or a biasing device such as a spring, so it is ready for another dispense cycle. This is referred to as the second portion of the rotation cycle.

The circumference of the rotating member 104 can be sized to control how much product is unwound from the roll 102. For example, a larger diameter rotating member 104 will dispense more product than a smaller diameter rotating member 104. Similarly, the length of the track 120*a* can be changed to accommodate different diameter rotating members 104.

In some implementations, the rotating member 104 is coupled directly to the roll 102 (e.g., the rotating member 104 engages the periphery of the roll 102) such that rotation of the roll 102 directly turns the rotating member 104 (as opposed to the rotating member 104 being coupled to the roll 102 through a spindle or drive roller 115).

As described above, in some implementations, the dispenser 100 includes a motor (not pictured). The motor is coupled to the roll 102 and operates to rotate the roll 102 in at least one of a first direction (e.g., clockwise) or a second direction (e.g., counterclockwise). The motor can be coupled to the roll 102, for example, through the first and second spindle arms 115*a, b* or the core support mechanism. In such implementations the motor turns the spindle arms 115*a, b* (one or both), or core support mechanism (e.g., through gears, belts, or another type of transmission or direct coupling) to rotate (e.g., unwind) the roll 102.

In some implementations, the dispenser 100 includes a proximity sensor (e.g., IR sensor) that detects a user movement, for example, in front of the dispenser 100 or in the vicinity of the throat 119, to indicate a user requesting a dispense. Upon such detection, for example, the motor actuates and causes the roll 102 to unwind and advance a portion of the roll 102 through the throat 119 to the user.

Embodiments

Embodiment 1. A paper product dispenser comprising a housing comprising a product holding area configured to hold a roll; a rotating member configured to rotate, in a first direction, in response to rotation of the roll; a cutting surface in the housing; a cutting blade coupled to the rotating member and having a first position, and a second position in which the cutting blade is in contact with the cutting surface, wherein the rotating member is configured to (i) move the cutting blade from the first position to the second position during a first portion of a rotation cycle of the roll in the first direction and (ii) move the cutting blade from the second position to the first position during a second portion of the rotation cycle of the roll in the first direction Embodiment 2. The paper product dispenser of embodiment 1, wherein the rotating member is coupled to the roll.

Embodiment 3. The paper product dispenser of embodiments 1 or 2, comprising a drive roller configured to rotate the roll, wherein the rotating member is coupled to the drive roller.

Embodiment 4. The paper product dispenser of embodiment 3, comprising a support roller horizontally offset from the drive roller and configured to, with the drive roller, support the roll.

Embodiment 5. The paper product dispenser of embodiment 4, wherein the support roller is below a core of the roll.

Embodiment 6. The paper product dispenser of any of embodiments 1-5, wherein the cutting blade includes an elongated track with teeth and a knife at an end of the track, and wherein the rotating member includes a circular gear with gear teeth matched to the teeth of the elongated track to move the cutting blade from the first position to the second position when the rotating member rotates.

Embodiment 7. The paper product dispenser of any of the preceding embodiments, wherein the rotating member includes a first circular gear with gear teeth along less than all of its circumference.

Embodiment 8. The paper product dispenser of embodiment 7, wherein the rotating member includes a second circular gear with gear teeth along its entire circumference.

Embodiment 9. The paper product dispenser of any of the preceding embodiments, wherein the rotating member is configured to move the cutting blade from the second position to the first position comprises moving the cutting blade from the second position to the first position by gravity.

Embodiment 10. The paper product dispenser of any of the preceding embodiments, the cutting blade is configured to move from the second position to the first position and back along an arcuate path.

Embodiment 11. A paper product dispenser comprising a housing comprising a product holding area configured to hold a roll; a rotating member configured to rotate, in a first direction, in response to rotation of the roll; a cutting surface in the housing; a cutting blade coupled to the rotating member and having a first position distal from the cutting blade and a second position in which the cutting blade is in contact with the cutting surface, wherein the rotating member is configured to (i) move the cutting blade from the first position to the second position during a first portion of a rotation cycle of the roll in the first direction and (ii) disengage the cutting blade during a second portion of the rotation cycle of the roll in the first direction.

Embodiment 12. The paper product dispenser of embodiment 11, comprising a drive roller configured to rotate the roll, wherein the rotating member is coupled to the drive roller.

Embodiment 13. The paper product dispenser of embodiment 12, comprising a support roller horizontally offset from the drive roller and configured to, with the drive roller, support the roll.

Embodiment 14. The paper product dispenser of embodiment 13, wherein the support roller is below a core of the roll.

Embodiment 15. The paper product dispenser of any of embodiments 12-14, wherein the drive roller comprises a gear with drive roller teeth, and the drive roller teeth engage the rotating member.

Embodiment 16. The paper product dispenser of any of embodiments 12-15, wherein the drive roller is vertically below a core of the roll.

Embodiment 17. The paper product dispenser of any of embodiments 12-16, comprising a motor configured to rotate the drive roller.

Embodiment 18. The paper product dispenser of any of embodiments 11-17, wherein the dispenser is a bath tissue dispenser.

While this specification contains many specific implementation details, these should not be construed as limitations on the scope of any inventions or of what may be claimed, but rather as descriptions of features specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination. Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments.

This written description does not limit the invention to the precise terms set forth. Thus, while the invention has been described in detail with reference to the examples set forth above, those of ordinary skill in the art may effect alterations, modifications and variations to the examples without departing from the scope of the invention.

What is claimed is:

1. A paper product dispenser comprising:

a housing comprising a product holding area configured to hold a roll;

a rotating member configured to rotate, in a first direction, in response to rotation of the roll;

a cutting surface in the housing;

a cutting blade coupled to the rotating member and having a first position, and a second position in which the cutting blade is in contact with the cutting surface, wherein the rotating member is configured to (i) move the cutting blade from the first position to the second position during a first portion of a rotation cycle of the roll in the first direction and (ii) move the cutting blade from the second position to the first position during a second portion of the rotation cycle of the roll in the first direction; and wherein the rotating member includes a first circular gear with gear teeth along less than all of its circumference and the rotating member includes a second circular gear with gear teeth along its entire circumference, wherein the first circular gear and the second circular gear are in a side-by-side relationship and have a same axis of rotation.

2. The paper product dispenser of claim 1, wherein the rotating member is coupled to the roll through a drive roller.

3. The paper dispenser of claim 2, wherein the gear teeth from the first circular gear engage the drive roller concurrently with the gear teeth from the second circular gear engaging the cutting blade.

4. The paper product dispenser of claim 1, comprising a drive roller configured to rotate the roll, wherein the rotating member is coupled to the drive roller.

5. The paper product dispenser of claim 4, comprising a support roller horizontally offset from the drive roller and configured to, with the drive roller, support the roll.

6. The paper product dispenser of claim 5, wherein the support roller is below a core of the roll.

7. The paper product dispenser of claim 1, wherein the cutting blade includes an elongated track with teeth and a knife at an end of the track, and wherein the gear teeth of the first circular gear are matched to the teeth of the elongated track to move the cutting blade from the first position to the second position when the rotating member rotates.

8. The paper product dispenser of claim 1, wherein the rotating member is configured to move the cutting blade from the second position to the first position comprises moving the cutting blade from the second position to the first position by gravity.

9. The paper dispenser of claim 1, wherein the cutting blade is configured to move from the second position to the first position and back along an arcuate path.

10. The paper dispenser of claim 1, wherein at least some of the gear teeth from the first circular gear are aligned with at least some gear teeth from the second circular gear.

11. A paper product dispenser comprising:

a housing comprising a product holding area configured to hold a roll;

a rotating member configured to rotate, in a first direction, in response to rotation of the roll;

a cutting surface in the housing;

a cutting blade coupled to the rotating member and having a first position distal from the cutting blade and a second position in which the cutting blade is in contact with the cutting surface, wherein the rotating member is configured to (i) move the cutting blade from the first position to the second position during a first portion of a rotation cycle of the roll in the first direction and (ii) disengage the cutting blade during a second portion of the rotation cycle of the roll in the first direction; and wherein the rotating member includes a first circular gear with gear teeth along less than all of its circumference and the rotating member includes a second circular gear with gear teeth along its entire circumference wherein the first circular gear and the second circular gear are in a side-by-side relationship and have a same axis of rotation.

12. The paper product dispenser of claim 11, comprising a drive roller configured to rotate the roll, wherein the rotating member is coupled to the drive roller.

13. The paper product dispenser of claim 12, comprising a support roller horizontally offset from the drive roller and configured to, with the drive roller, support the roll.

14. The paper product dispenser of claim 13, wherein the support roller is below a core of the roll.

15. The paper product dispenser of claim 12, wherein the drive roller comprises a gear with drive roller teeth, and the drive roller teeth engage the rotating member.

16. The paper product dispenser of claim 12, wherein the drive roller is below a core of the roll.

17. The paper product dispenser of claim 11, wherein the dispenser is a bath tissue dispenser.

* * * * *